United States Patent [19]

Yokokawa et al.

[11] Patent Number: 4,952,782

[45] Date of Patent: Aug. 28, 1990

[54] FIXING UNIT FOR ELECTROPHOTOGRAPHIC DEVICE

[75] Inventors: Syuho Yokokawa; Shinichi Fukazawa; Yasuō Kikuchi; Takashi Suzuki; Isao Nakajima, all of Ibaraki, Japan

[73] Assignee: Hitachi Koki Co., Ltd., Tokyo, Japan

[21] Appl. No.: 267,566

[22] Filed: Nov. 7, 1988

[30] Foreign Application Priority Data

Nov. 6, 1987 [JP] Japan ..... 62-281494

[51] Int. Cl.[5] ..... B21B 27/06; H05B 3/02; G03G 15/20

[52] U.S. Cl. ..... 219/469; 29/123; 355/290

[58] Field of Search ..... 29/123, 119, 110; 355/285, 290, 295; 403/365, 371, 356; 219/216, 469, 470

[56] References Cited

U.S. PATENT DOCUMENTS

| | | | |
|---|---|---|---|
| 4,104,760 | 8/1978 | Rosseau | 29/123 |
| 4,229,950 | 10/1980 | Fessenden | 29/123 |
| 4,495,683 | 1/1985 | Delhaes | 29/119 |
| 4,570,044 | 2/1986 | Kobayashi et al. | 219/216 |
| 4,595,274 | 1/1986 | Sakurai | 219/216 |
| 4,714,819 | 12/1987 | Yamashita | 219/216 |
| 4,780,078 | 10/1988 | Masui | 219/216 |

*Primary Examiner*—Fred L. Braun
*Assistant Examiner*—Sandra L. Hoffman
*Attorney, Agent, or Firm*—Cushman, Darby & Cushman

[57] ABSTRACT

A fixing roller used in an electrophotographic device includes a coupling with a drive key that engages an end of a pressing roll that contains a key groove. Disposed between the coupling and the end of the pressing roll is a spacing member. This spacing member decreases the rate at which the key groove and the drive key deteriorate when two fixing rollers are used as pair to fix toner on a printed page. The spacing member is made of plastic, a sintered metal alloy, or other material. Also, the spacing member is lubricated to further prevent friction and the key groove of the pressing roll is lined with an abrasion resistant material to further prevent deterioration of the drive key and the key groove.

15 Claims, 3 Drawing Sheets

FIXING UNIT FOR ELECTROPHOTOGRAPHIC DEVICE

BACKGROUND OF THE INVENTION

1. Field of the Art:

The present invention relates to a fixing roller in a fixing unit of an electrophotographic device.

2. Background of the Prior Art:

A known electrophotographic printing device is shown in FIG. 1. During operation, an electrifier 12 charges each point of photosensitive element 14 to a uniform potential. As photosensitive element 14 rotates, certain points are radiated with light 16, such as a laser beam. These radiated points of photosensitive element 14 form an electrostatic latent image, which is then developed into a printed image.

A developer 18 supplies toner to the photosensitive element 14 and the toner adheres to the latent image existing on photosensitive element 14. Transfer unit 20 then transfers the toner on photosensitive element 14 to paper 22.

Once the toner is transferred to paper 22, paper 22 passes through fixing rollers 24, and, through heating and pressurization, the toner will permanently adhere to paper 22. At least one of fixing rollers 24 contains a heating element so that the heating can take place.

FIGS. 2 and 3 further illustrate the construction of a fixing roller 24 that contains a heating element. A fixing roller 24 not containing the heating element is similarly constructed but does not contain the heating element. Disposed within the fixing roller 24 is a heater lamp 34, which heats a cylindrical pressing roll 26 and is detachably mounted to a receptacle disposed in each end of a transmission shaft 28. Pressing roll 26 is typically made from aluminum of high heat conductivity and has a surface coated with a noncohesive resin such as teflon or silicone rubber.

Fixing roller 24 is driven by a rotating transmission shaft 28. Force from transmission shaft 28 is transferred coupling 30, which is connected to the end of shaft 28 as shown in FIG. 2. Coupling 30 contains a drive key 32 that engages a key groove 36 formed at one edge of pressing roll 26. Rotation of transmission shaft 28 therefore causes rotation of fixing roller 24.

However, this coupling arrangement of transmission shaft 28 to fixing roller typically breaks down after about 12,000 pages have been printed, as illustrated in FIG. 6. The cause of this breakdown, as illustrated in FIG. 4, is the presence of a gap L between coupling 30 and pressing roll 26. Gap L is created because of the difference in the thermal expansions of coupling 30 and pressing roll 26 and also the size tolerance.

When a pair of pressing rolls 26 are brought in contact under pressure and driven with drive key 32, each pressing roll 26 exerts pressure on the opposite pressing roll. When pressing rolls 26 rotate, this causes coupling 30 to travel a planetary path within pressing roll 26, as illustrated by the sequence of FIGS. 4A–4C. Specifically, the outer periphery of coupling 30 that is at the pressure point P will always be in the strongest contact with the inside of pressing roll 26.

This motion causes sliding abrasion between drive key 32 and key groove 36 and the creation of abrasion dust. Thus, both drive key 32 and key groove 36 become worn, and, eventually, pressing roll 26 will not rotate. The whole fixing roll 24 must then be replaced, despite the remaining life of the noncohesive resin disposed on pressing roll 26. Also, this motion causes increased external noise, which results in loud and annoying operation.

The above description illustrates that an improved fixing roller is needed to obtain a more reliable and longer lasting electrophotographic device.

SUMMARY OF THE INVENTION

The object of the present invention is to provide a fixing roll that does not deteriorate as quickly as prior art fixing rollers.

A further object of the invention is to provide a fixing roller in which the drive key of the coupling and the key groove of the pressing roll do not deteriorate quickly.

These objects, and others, are attained by providing a fixing that, in addition to possessing a coupling with a drive key and a pressing roll with a key groove, contains a spacing member between the coupling and the end of the pressing roll containing the key groove. This spacing member suppresses the sliding abrasion caused by the planetary motion of the coupling within the pressing roll when two fixing rollers, which function as a fixing unit, are used to adhere toner to a printed page and results in a longer lasting fixing roller requiring less maintenance.

This spacing member can also be used between a coupling not possessing a drive key and a pressing roll not containing a key groove.

Also, lining the key groove with an abrasion resistant material, such as iron, further prevents deterioration of the key groove and drive key.

BRIEF DESCRIPTION OF THE DRAWINGS

These and other advantages of the present invention may be appreciated from studying the following detailed description of the preferred embodiment with reference to the drawings in which.

DETAILED DESCRIPTION OF THE PREFERRED EMBODIMENT

Figure 5:
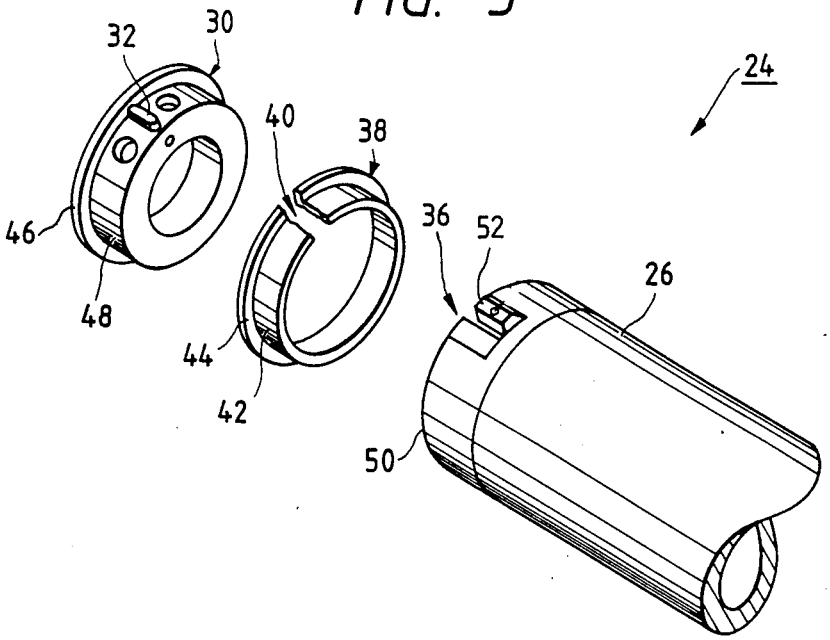
FIG. 5 is a perspective view showing an embodiment of the present invention.

FIG. 5 illustrates the preferred embodiment of the present invention in which a fixing roller 24 includes a coupling 30, a spacing member 38, and a pressing roll 26. A pair of two fixing rollers 24 make up the fixing unit that permanently adheres toner to the printed page in an electrophotographic device.

Spacing member 38 is made of a high temperature resistant plastic and is coated with a heat-resistant grease to lubricate the friction that will exist between spacing member 38 and both coupling 30 and pressing roll 26. Spacing member 30 can also be made from a metal sintered alloy or other material having suitable hardness and sliding characteristics. Also, the plastic or other material used to make spacing member 38 preferably has a coefficient of thermal expansion greater than that of aluminum, but effective results can be obtained using a material with a smaller coefficient of thermal expansion.

As shown in FIG. 5, spacing member 38 is formed with an opening 40 into which drive key 32 fits. Although constructed out of one piece of plastic, spacing member 38 contains an outer wall 44 that prevents direct contact from occurring between end face 46 of coupling 30 and end face 50 of pressing roll 26 and also an inner portion 42 that prevents direct contact between inner portion 48 of coupling 30 and the inner periphery of pressing roll 26.

Also, key groove 36 is lined with an abrasion resistant material 52, such as iron.

Figure 1:
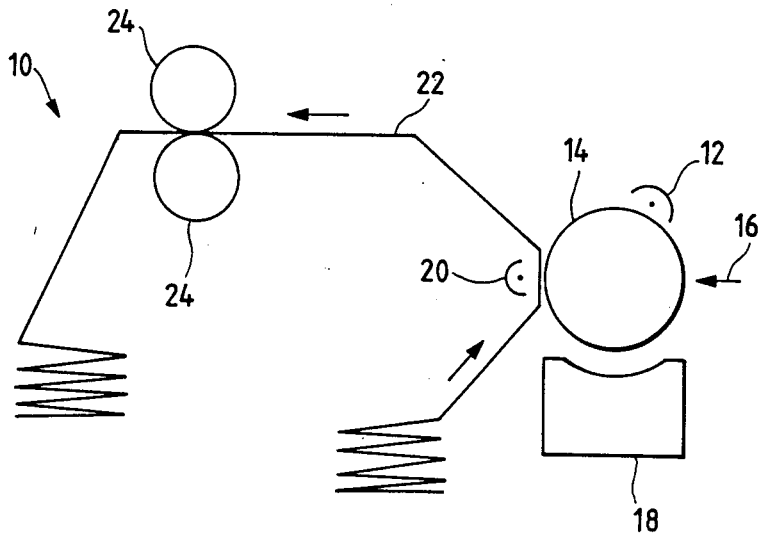
FIG. 1 (PRIOR ART)
FIG. 1 is a schematic diagram of a conventional printing apparatus.
Figure 2:
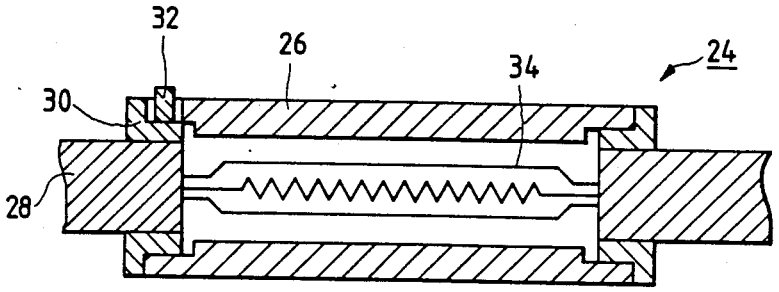
FIG. 2 (PRIOR ART)
FIG. 2 is a side, sectional view of a conventional fixing roller.
Figure 3:
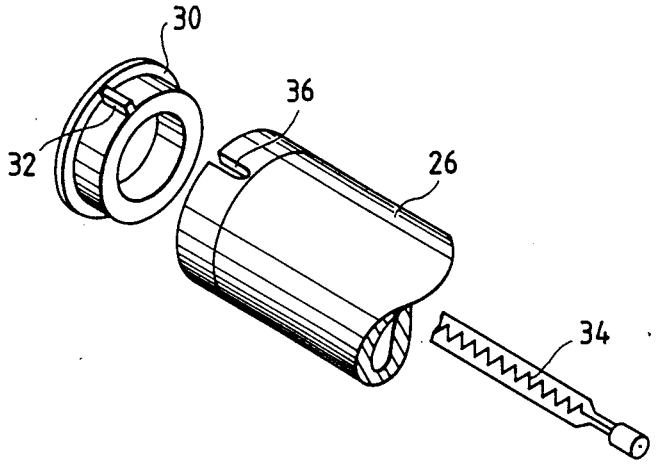
FIG. 3 (PRIOR ART)
FIG. 3 is a perspective view showing the driving mechanism of the conventional fixing roller.
Figures 4A, 4B, 4C, 4D:
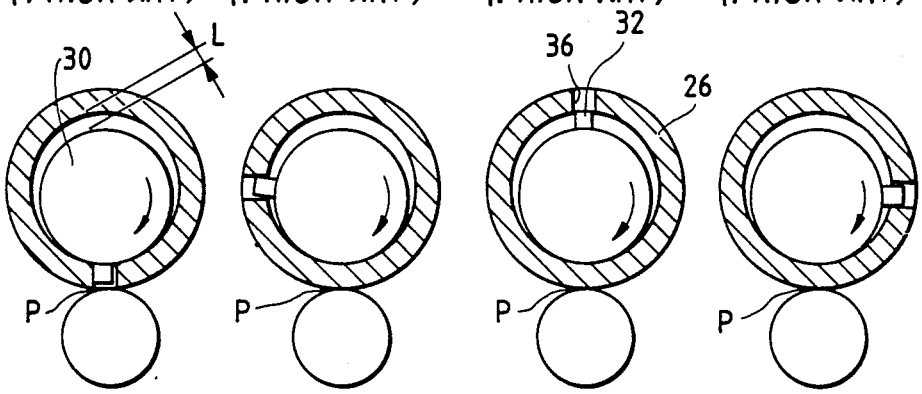
FIG. 4(A) (PRIOR ART) FIG. 4(B) (PRIOR ART) FIG. 4(C) (PRIOR ART) FIG. 4(D) (PRIOR ART)
FIGS. 4A–4D illustrate the reason for breakdown of conventional fixing rollers using a rotation sequence of the conventional fixing roller.

With this construction, drive key 32 and key groove 36 will not deteriorate as with a conventional fixing roller because the planetary motion as explained with reference to FIG. 4 is greatly reduced.

Figure 6:
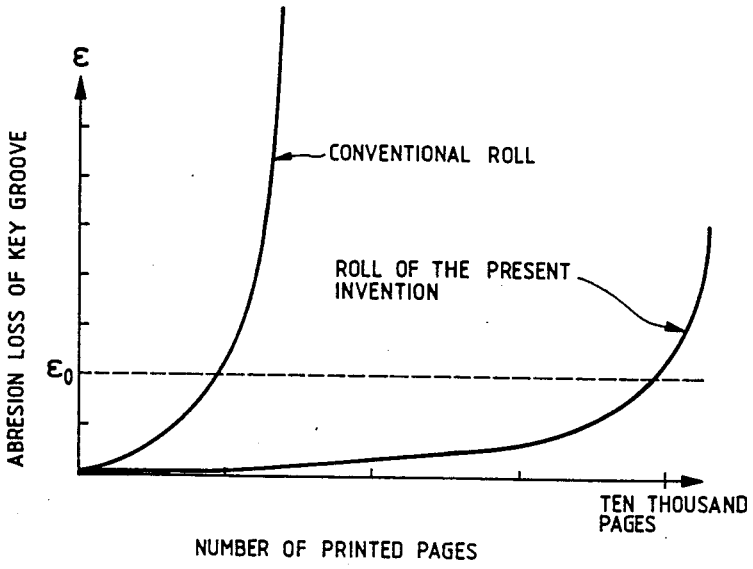
FIG. 6 is a graph showing the lifetimes of both a conventional fixing roller and a fixing roller according to the present invention.

FIG. 6 graphically illustrates the abrasion loss E as a function of the number of pages printed for both a conventional fixing roller and the fixing roller according to the present invention. When abrasion loss E reaches a limit value Eo, replacement of the fixing roller is necessary. As illustrated, the fixing roller of the present invention will four times longer than a conventional fixing roller.

Spacing member 38 was previously described with reference to the side of fixing roller 24 in which the driving force was transmitted from transmission shaft 28, through coupling 30, and to pressing roll 26. However, spacing member 30 can also be used between a coupling that does not contain a drive key and a pressing roll not containing a key groove.

While the invention has been described in connection with what is the presently preferred embodiment, it is to be understood that the invention is not limited to the disclosed embodiment, but, on the contrary, is intended to cover various modifications and equivalent arrangements included within the spirit and scope of the appended claims.

What is claimed is:

1. A fixing roller for a fixing unit of an electrophotographic device that is rotated by a transmission shaft comprising:

a cylindrical pressing roll having two open ends, a periphery of said pressing roll at one end containing a key groove;

means for coupling said pressing roll to said transmission shaft, said coupling means including a drive key that engages said key groove; and a spacing member disposed between said end of said pressing roll containing said key groove and said coupling means that reduces friction between said pressing roll and said coupling means.

2. A fixing roller according to claim 1 wherein said spacing member is made of high temperature resistant plastic.

3. A fixing roller according to claim 1 wherein said spacing member has a coefficient of thermal expansion that is greater than a coefficient of thermal expansion of said pressing roll.

4. A fixing roller according to claim 1 further including a heating element disposed within said pressing roll.

5. A fixing roller according to claim 1 further including a heat resistant lubricant disposed between said spacing member and said coupling means and said spacing member and said pressing roll.

6. A fixing roller according to claim 1 wherein said spacing member includes an opening for said drive key.

7. A fixing roller according to claim 1 further including an abrasion resistant material that lines said groove key.

8. A fixing roller according to claim 7 wherein said abrasion resistant material is iron.

9. A fixing apparatus for an electrophotographic device that permanently adheres toner to a printed page and is powered by two transmission shafts comprising:

a pair of rotatable fixing rollers that operate in conjunction to pressure said toner on said printed page, one of said fixing rollers including:

a cylindrical pressing roll having two open ends, a periphery of said pressing roll at one end containing a key groove, means for coupling said pressing roll to said one of said two transmission shafts, said coupling means including a drive key that engages said key groove, and a spacing member disposed between said end of said pressing roll containing said key grooves and said coupling means that reduces friction between said pressing roll and said coupling means; and a heating element disposed within one of said fixing rollers.

10. A fixing apparatus according to claim 9 wherein said spacing member is made of high temperature resistant plastic.

11. A fixing apparatus according to claim 9 wherein said spacing member has a coefficient of thermal expansion that is greater than a coefficient of thermal expansion of said pressing roll.

12. A fixing apparatus according to claim 9 further including a heat resisting lubricant disposed between said spacing member and said coupling means and said spacing member and said pressing roll.

13. A fixing apparatus according to claim 9 wherein said spacing member includes an opening for said drive key.

14. A fixing apparatus according to claim 9 further including an abrasion resistant material that lines said groove key.

15. A fixing apparatus according to claim 14 wherein said abrasion resistant material is iron.

* * * * *